US012516572B2

(12) United States Patent
Kerstetter

(10) Patent No.: US 12,516,572 B2
(45) Date of Patent: Jan. 6, 2026

(54) DRILLING MOTOR BEARING ASSEMBLY HAVING BOTH AN INTERNAL AND AN EXTERNAL BEND

(71) Applicant: LEGACY DIRECTIONAL DRILLING LLC, Scott, LA (US)

(72) Inventor: Scott Kerstetter, Scott, LA (US)

(73) Assignee: LEGACY DIRECTIONAL DRILLING LLC, Scott, LA (US)

( * ) Notice: Subject to any disclaimer, the term of this patent is extended or adjusted under 35 U.S.C. 154(b) by 0 days.

(21) Appl. No.: 19/049,537

(22) Filed: Feb. 10, 2025

(65) Prior Publication Data

US 2025/0257611 A1 Aug. 14, 2025

Related U.S. Application Data

(60) Provisional application No. 63/552,289, filed on Feb. 12, 2024.

(51) Int. Cl.

| | |
|---|---|
| ***E21B 4/00*** | (2006.01) |
| ***E21B 4/02*** | (2006.01) |
| ***E21B 7/06*** | (2006.01) |

(52) U.S. Cl.

CPC ..... *E21B 4/003* (2013.01); *E21B 4/02* (2013.01); *E21B 7/068* (2013.01)

(58) Field of Classification Search

CPC ..... E21B 4/003; E21B 4/02; E21B 7/068

See application file for complete search history.

(56) References Cited

U.S. PATENT DOCUMENTS

| | | | | |
|---|---|---|---|---|
| 9,279,289 | B2 * | 3/2016 | Kerstetter | E21B 4/003 |
| 2013/0319764 | A1 * | 12/2013 | Schaaf | E21B 7/068 175/50 |

* cited by examiner

*Primary Examiner* — Dany E Akakpo

(74) *Attorney, Agent, or Firm* — Jeffrey L. Wendt; The Wendt Firm, P.C.

(57) ABSTRACT

Drilling motor power section and thrust bearing assemblies. A thrust bearing housing having threaded ends, an inside surface, an inside diameter, a generally cylindrical outside surface, an outer diameter, a longitudinal axis parallel to the outside surface, the inside surface defining a longitudinal bore having a longitudinal axis skewed at a first angle from the housing longitudinal axis. The power section has a generally cylindrical motor housing having an inside surface, a rotor and a stator, the rotor connected to a flex rod drive shaft in turn connected via a universal joint assembly to a flow diverter. The flow diverter is connected to a pin end of a mandrel. The mandrel has a second end forming a drive shaft and bit box, the inside surface of the motor housing defining a longitudinal bore having a longitudinal axis skewed at a second angle from the thrust bearing tubular housing longitudinal axis.

17 Claims, 6 Drawing Sheets

400

402

A method of drilling a well bore in a subterranean formation having at least one deviated section, the method comprising:

404 assembling a drillstring by:

i) connecting a positive displacement motor housing of a positive displacement power section to a thrust bearing assembly above a drill bit in a drillstring, the thrust bearing assembly comprising:

A) a tubular thrust bearing housing having first and second threaded ends, an inside surface, an inside diameter, a generally cylindrical outside surface, an outer diameter, the tubular thrust bearing housing having a longitudinal axis parallel to the generally cylindrical outside surface, the inside surface defining a longitudinal bore having a longitudinal axis skewed at a first angle from the thrust bearing housing longitudinal axis;

B) A thrust bearing stack having an outside surface adjacent the inside surface of the tubular thrust bearing housing, and an inside surface adjacent a tubular, generally cylindrical, rotatable mandrel connecting a flow diverter of a drilling motor power section with a drive shaft for a drill bit;

C) The tubular, generally cylindrical mandrel having a central longitudinal bore having a mandrel longitudinal axis identical to the skewed longitudinal axis of the tubular housing such that the mandrel and drill bit are skewed at the first angle to the tubular housing;

D) the positive displacement power section comprising a generally cylindrical motor housing having an inside surface, a rotor and a stator, the rotor connected at one end to a flex rod drive shaft, the flex rod drive shaft in turn threadedly connected via a universal joint assembly to the flow diverter the flow diverter having a lower diverter box end threadedly connected to a threaded pin end of the mandrel having a second end forming a drive shaft and bit box, the inside surface of the motor housing defining a longitudinal bore having a longitudinal axis, the longitudinal axis skewed at a second angle from the thrust bearing tubular housing longitudinal axis;

E) the first end of the thrust bearing tubular housing threadedly connected to the generally cylindrical motor housing, the second end of the thrust bearing tubular housing connected to a radial bearing housing enclosing a radial bearing for the mandrel;

Ⓐ

FIG. 7

DRILLING MOTOR BEARING ASSEMBLY HAVING BOTH AN INTERNAL AND AN EXTERNAL BEND

CROSS-REFERENCE TO RELATED APPLICATIONS

This application is entitled to and claims the benefit of earlier filed provisional application No. 63/552,289, filed Feb. 12, 2024, under 35 U.S.C. § 119 (e), which earlier filed application is incorporated by reference herein in its entirety.

BACKGROUND INFORMATION

Technical Field

The present disclosure relates generally to the field of downhole drilling motors, sometimes referred to as mud motors, and more particularly to drilling motor bearing assemblies having both an internal bend and an external bend, drillstrings including same, and methods of use.

Background Art

Down hole drilling motors are used within the oil and natural gas industry for earth boring operations. In some prior arrangements, such as the arrangement generally designated 1 as illustrated in FIG. 1 from my U.S. Pat. No. 9,279,289, a mandrel 4 connects a drill bit through an output or drive shaft 6 and bit box 24 to a flow diverter 2 (also sometimes called a flow restrictor), the flow diverter 2 in turn connected to the rotor of the drilling motor through a transmission via an upper box 5, (the transmission, drill bit and drilling motor are not illustrated in FIG. 1). In the arrangement illustrated in FIG. 1, a straight, non-tapered threaded pin 12 of mandrel 4 connects mandrel 4 to a lower flow diverter box end 14 through a straight stub acme pin. A tapered threaded connection between the mandrel and flow diverter may also be used. Also illustrated are an upper bearing housing 8 threadedly connected to a lower bearing housing 26 at threaded connection 28; a drilling motor housing 10 threadedly connected at 11 to upper bearing housing 8; upper and lower radial bearings 16 and 18 (typically roller, ball bearing, or marine type); a thrust bearing stack 20; and a mandrel catch 22. Also illustrated are central bores 7 and 9 of the mandrel 4 and flow diverter 2, respectively, generally centered along a longitudinal axis L.

Directional drilling, that is, the change in direction of drilling in the bore of subterranean well, involves change in direction to produce a straightening of the well due to the deflection of the rotary drill from the desired direction by a particular rock strata. In other instances, the change in direction is intentional in order to reach a formation that is laterally displaced from the existing location of the bore hole.

One of the most common expedients for changing the direction of drilling has been the insertion in the drilling or work string, at a point above a downbole motor that drives the rotary drill bit, of an apparatus which is called a bent sub. Such bent subs are rigidly connected at one end to the work string and have their other connecting end angularly disposed relative to the axis of the work string to which they are connected, so that when the motor and supported drill bit are rigidly connected thereto, the axis of the drill bit will be angularly inclined relative to the axis of the well bore existing prior to insertion of the bent sub.

Alternatively, as illustrated schematically in FIG. 1, the required bend for changing the drilling direction may be incorporated directly in the downhole motor housing 10 typically above the motor bearing pack. Such apparatus are known as the "fixed bend housing" or "bent motor housing" and work in a substantially similar fashion to bent subs. As illustrated in FIG. 1 at an upper portion of the drilling motor housing 10. The "bent motor housing" is indicated as having a longitudinal axis L1 angled from L at an angle "α" (alpha). Drillstring designers refer to the position of the bend as a "bend plane" or simply as the "bend", indicated in FIG. 1 at B.

Still another method of changing the direction of drilling is the incorporation of an eccentric or offset stabilizer at the lower end of the drill string below the downhole motor and near the drill bit (defining a near bit stabilizer).

In addition, it has been found that directional drilling capabilities can be further enhanced by combining an offset near bit stabilizer with a bent sub or bent motor housing. However, this enhancement is maximized only if the offset stabilizer is radially aligned with the angle in the bent sub or bent motor housing. Unfortunately, because of the threaded connections between the drill suing segments and the offset stabilizer, only random angular orientations with respect to the bent sub or bent motor housings and the offset stabilizer are produced. This is a significant drawback to the overall efficiency of directional drilling when an offset stabilizer is used in combination with a bent sub or bent motor housing.

More recently, rotary steering systems ("RSS") have been developed. An RSS uses complex, electromechanical systems that include sensors, onboard computers, and advanced control systems to continuously orient the drill bit in the desired direction, while the entire RSS and drill pipe continue to rotate.

Drillstring designers and operators are desirous of designs that make the bend plane B very close to the bit. This is very desirable to reduce stress on the motor and "build" greater angle when directional drilling due to the shorter distance from bend to bit. ("Build" is an industry term meaning curvature of a well bore.) Replacement of drilling motor bearings, mandrels, or components thereof are all costly operations and thus to be avoided if at all possible. The present disclosure addresses one or more of these problems.

SUMMARY

In accordance with the present disclosure, drilling motor thrust bearing assemblies having an offset or skewed internal diameter housing as well as an offset or skewed external housing, drilling motor assemblies and drillstrings including same, and methods of use are presented which may increase life of such bearings and assemblies and meet the demands for shorter distance from bit to bend. The apparatus and methods of the present disclosure make the bend both internal and external to the bearing section therefore putting the bend very close to the bit. This is very desirable as there will be less stress on the motor and it will build a lot of angle when directional drilling due to the short distance from bend to bit.

One aspect of the disclosure are drilling motor power sections and thrust bearing assemblies, comprising:

a) a thrust bearing tubular housing having first and second threaded ends, an inside surface, an inside diameter, a generally cylindrical outside surface, an outer diameter, the thrust bearing tubular housing having a longitudinal axis parallel to the generally cylindrical outside surface, the inside surface defining a longitudinal bore having a bore longitudinal axis skewed at a first angle from the thrust bearing housing longitudinal axis;

b) a thrust bearing stack having an outside surface adjacent the inside surface of the thrust bearing tubular housing, and an inside surface configured to be adjacent a tubular, generally cylindrical, rotatable mandrel connecting a flow diverter of a drilling motor power section with a drive shaft for a drill bit;

c) the tubular, generally cylindrical mandrel having a central longitudinal bore having a mandrel longitudinal axis identical to the skewed longitudinal axis of the tubular housing such that the mandrel and drill bit are skewed at the first angle to the tubular housing;

d) a positive displacement drilling motor power section having a generally cylindrical motor housing having an inside surface, a rotor and a stator, the rotor connected at one end to a flex rod drive shaft, the flex rod drive shaft in turn threadedly connected via a universal joint assembly to the flow diverter, the flow diverter having a lower diverter box end threadedly connected to a threaded pin end of the mandrel, the mandrel having a second end forming a drive shaft and bit box, the inside surface of the motor housing defining a longitudinal bore having a longitudinal axis, the longitudinal axis skewed at a second angle from the thrust bearing tubular housing longitudinal axis;

e) the first end of the thrust bearing tubular housing threadedly connected to the generally cylindrical motor housing, the second end of the thrust bearing tubular housing connected to a radial bearing housing enclosing a radial bearing for the mandrel.

In certain embodiments, the thrust bearing housing may have a transverse cross-section such that the inside diameter and outside diameter are constant, wherein a center of first circle defined by the outside diameter is positioned on the longitudinal axis, and a center of a second circle defined by the inside diameter is on the skewed longitudinal axis. In certain embodiments, the inside surface is generally cylindrical, where the term "generally" simply means that the inside and outside surfaces may not be exactly cylindrical, either due to surface roughness, out of roundness, or mechanical impacts before, during, and after use.

In certain embodiments, the first (internal) skew angle, defined as "β" (beta) in the drawings, may range from about 0.5 to about 5 degrees, or from about 0.5 to about 2 degrees, or about 0.75 degrees, where "about" in these ranges means within 0.5, or within 0.3 degrees. In certain embodiments, the second (external) skew angle, defined as "μ" (mu), may range from about 0.5 to about 5 degrees, or from about 0.5 to about 2 degrees, or about 1.75 degrees, where "about" in these ranges means within 0.5, or within 0.3 degrees. The combination (addition) of the first and second angles allows a total bend angle greater than can be accomplished with either one alone. The total bend angle (β+μ) may then range from about 1.0 to about 10 degrees, or from about 1.0 to about 4 degrees, or about 2.5 degrees.

In certain embodiments the thrust bearing stack may comprise bearing members selected from the group consisting of thrust ball bearings, angular contact thrust ball bearings, cylindrical roller thrust bearings, needle roller thrust bearings, spherical roller thrust bearings, tapered roller thrust bearings, and combinations thereof.

In certain embodiments the thrust bearing stack may be lubricated by a fluid selected from the group consisting of drilling fluid, reservoir fluid, or combination thereof.

Other aspects of the disclosure are drillstrings comprising a drilling motor power section and thrust bearing assembly of this disclosure and a drill bit secured to the bit box, and methods of drilling a well bore in a subterranean formation having at least one deviated section using a drillstring of this disclosure.

BRIEF DESCRIPTION OF THE DRAWINGS

The manner in which the objectives of the disclosure and other desirable characteristics can be obtained is explained in the following description and attached schematic drawings in which.

Figure 1:
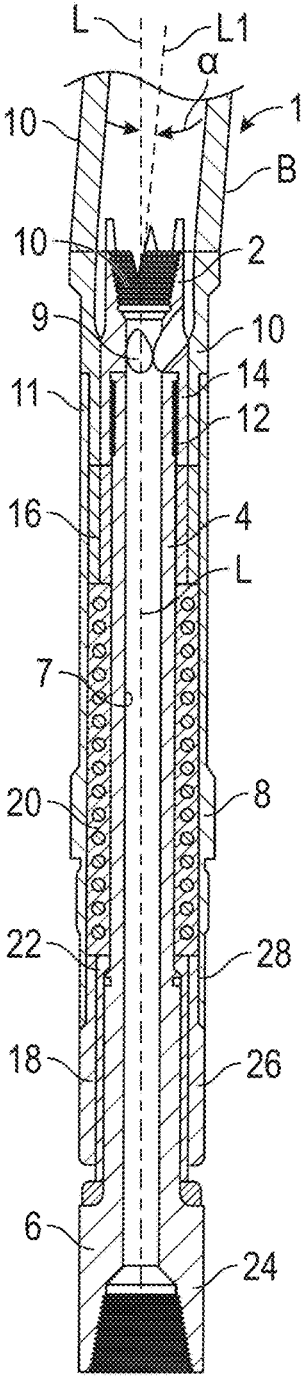
FIG. 1 (Prior Art)
FIG. 1 is a cross-sectional view of a prior art bent drilling motor housing design.

It is to be noted, however, that the appended drawings are schematic only, may not be to scale, illustrate only typical embodiments of this disclosure, and are therefore not to be considered limiting of its scope, for the disclosure may admit to other equally effective embodiments.

DETAILED DESCRIPTION

In the following description, numerous details are set forth to provide an understanding of the disclosed apparatus and methods. However, it will be understood by those skilled in the art that the apparatus and methods covered by the claims may be practiced without these details and that numerous variations or modifications from the specifically described embodiments may be possible and are deemed within the claims. All published patent applications and patents referenced herein are hereby explicitly incorporated herein by reference. In the event definitions of terms in the referenced patents and applications conflict with how those terms are defined in the present application, the definitions for those terms that are provided in the present application shall be deemed controlling. All percentages herein are based on weight unless otherwise specified.

As used herein, "offset" means the distance between centers of otherwise concentric circles defined by inside and outside diameter of a cylindrical, tubular member. "Skewed" and "skew angle" means the amount, measured in degrees of angle, that two lines have between them is greater than 0. "Deviated", means a well bore that is non-vertical, and in some case means horizontal. "Bend", when used as a verb, has units of degrees, and means the angle between the downhole mud motor and the drill bit, used to achieve "build" or turn while "sliding." Usually a mud motor is "dialed" at about 1.8 degrees to about 2.8 degrees on the build section, and ranging from about 1.5 degrees to about 1.8 degrees on a horizontal section, where "about" means+/−0.2 degrees. "Build" as used herein means increase of inclination; in horizontal drilling also decrease in TVD (true vertical depth) as a direct result of building angle, as opposed to drop. "Build rate" means inclination angle difference between two consecutive survey points, extrapolated to 30 meters (or 100 feet), and is measured in a vertical plane. Typical build rates in a build section of a horizontal well are 6-8°/30 meters. "Inclination" means angle between a tangent to the wellpath and a vertical line, measures the deviation from vertical at a certain point, measured with pendulum, accelerometer or gyroscope. Inclination increases in the build section, is 90° in a perfectly horizontal well, and can exceed 90° in a horizontal well that points up. A vertical well has inclinations close or equal to 0°. "Wellpath" means the trajectory of a directionally drilled well in three dimensions. "Sliding" refers to drilling without rotating the entire drillstring (by way of the rotary table or top-drive); rotation of bit occurs only below the bend, achieved by the mud driven downhole motor. These terms are defined in various glossaries, including the Schlumberger Oilfield Glossary, and the geosteering glossary of on the website of Chinook Consulting, Calgary, Alberta, CA.

Figure 2:
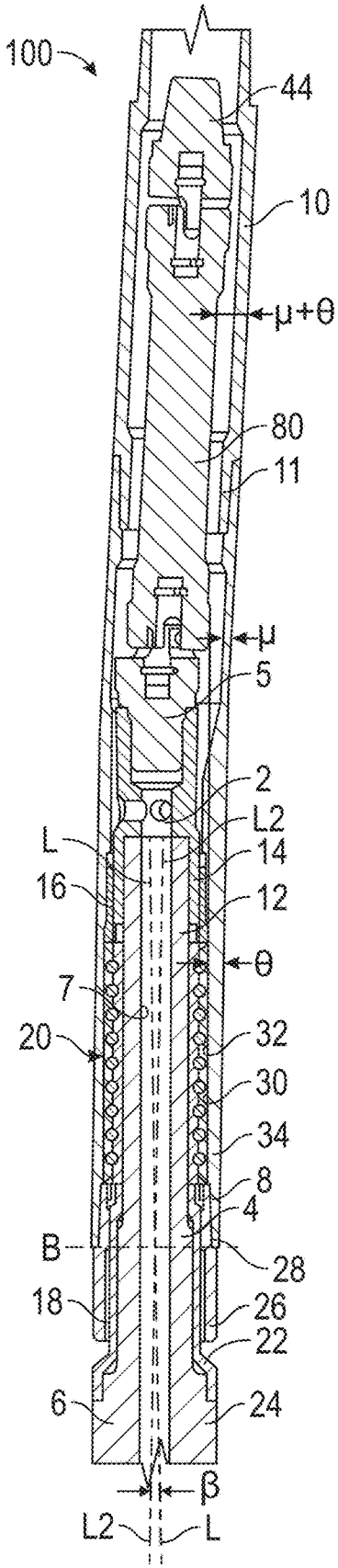
FIG. 2 is a cross-sectional view of one embodiment of a bearing assembly in accordance with the present disclosure, illustrating connection of a mandrel to a flex rod through a universal joint assembly.

FIG. 2 is a cross-sectional schematic illustration view of one bearing assembly embodiment 100 of the present disclosure, illustrating connection of a mandrel to a flex rod through a universal joint assembly. In contrast to the prior art embodiment 1 illustrated schematically in FIG. 1, the bearing assembly embodiment 100 illustrated schematically in FIG. 2 includes a thrust bearing housing 8 having an outside surface 34, an offset bore 30, and an inside surface 32. Offset bore 30 has a longitudinal axis L2 angle at a first offset or skew angle "β" ranging from about 0.5 to about 5 degrees, or from about 0.5 to about 2 degrees. This positions the bend plane B much closer to the bit (not illustrated) that would be attached to bit box 24. FIG. 2 also illustrates schematically a portion of a flex rod 44 and a universal joint assembly 80, the latter connecting flex rod 44 with mandrel 4.

FIG. 2 further illustrates the offset nature of bore 30 of thrust bearing housing 8 and bore 7 of mandrel 4. The angle "θ" (theta) is the angle between a line representing outside surface 34 of housing 8 and a line representing inside surface 32 of housing 8. Angles θ and β should be very nearly equal. FIG. 2 also illustrates and external offset or second angle "μ" (mu) of a motor power section housing 10. The angle "μ" (mu) is the angle between lines representing outside and inside surfaces of motor housing 10. The combined (addition) of angles θ and μ are also illustrated. The sum of first (internal bend) angle θ and second (external bend) angle μ is the angle between a line representing inside surface 32 of housing 8 and a line representing outside surface of motor housing 10.

Figure 3:
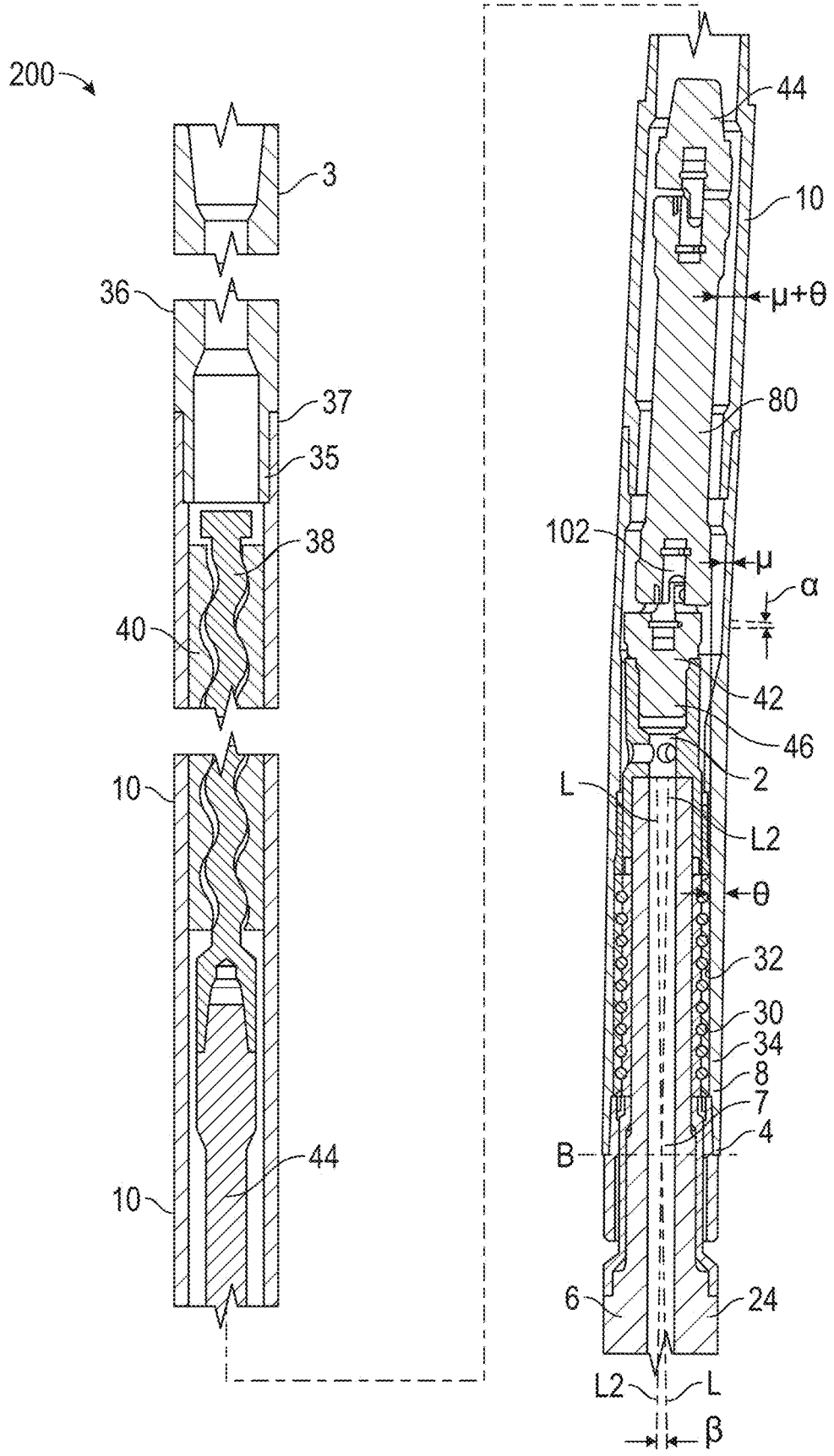
FIG. 3 is a cross-sectional view of a drilling motor power section connected to the bearing assembly illustrated schematically in FIG. 2 and a portion of a drillstring.

FIG. 3 is a cross-sectional schematic illustration view of a drilling motor power section connected to the bearing assembly illustrated schematically in FIG. 2 and a portion of a drillstring, embodiment 200. Drilling or mud motor housing 10 houses a rotor 38 and stator 40, as is known in typical Moineau positive displacement motors (PDM). An upper sub 36 connects upward to a drillstring (not illustrated). Upper sub 36 is connected to PDM housing 10 using a threaded pin 35 and box 37. A flex rod drive shaft 44 is enclosed by PDM motor housing 10. Flex rod drive shaft 44 is connected via threaded fittings to PDM rotor 38 and to a connecting rod 104 (FIG. 4) of the universal joint mentioned herein. Connecting rod 104 connects flex rod drive shaft 44 to a cylindrical driven body member 80, which may be considered the middle part of the universal joint. Cylindrical driven body member 80 in turn connects through another connecting rod 102 (FIG. 6) to flow diverter 2. Both connecting rods 102 104 are held in tapered bores, as further described herein, allowing the connecting rods some "play" at an angle "γ" as illustrated schematically in FIG. 3 for connecting rod 102. Angle γ should be at least as large as angles β and θ.

Figure 4:
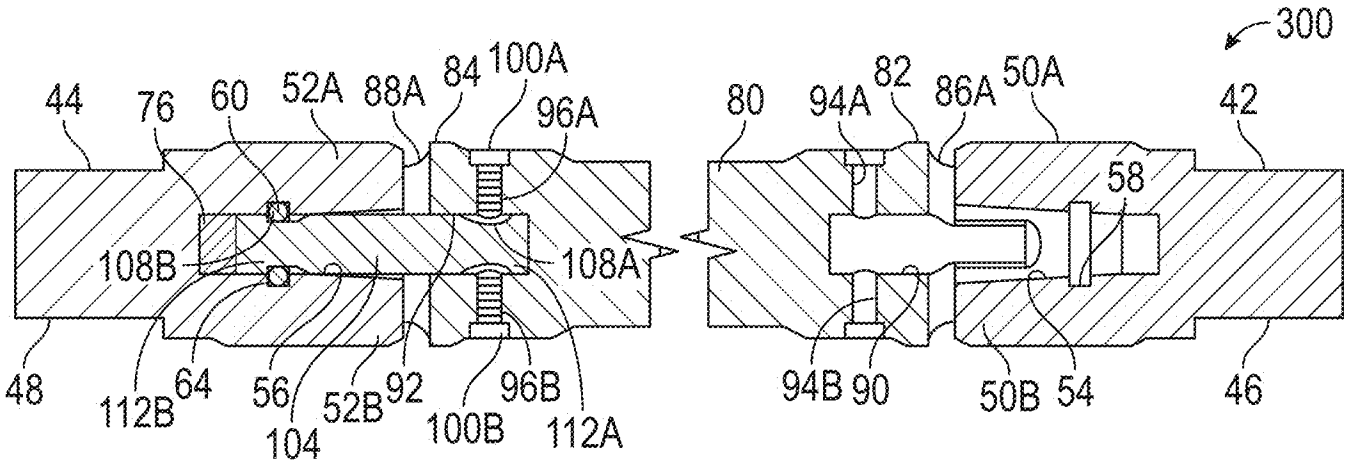
FIG. 4 is a cross-sectional view of the universal joint assembly illustrated schematically in the embodiment illustrated in FIGS. 2 and 3.
Figure 5:
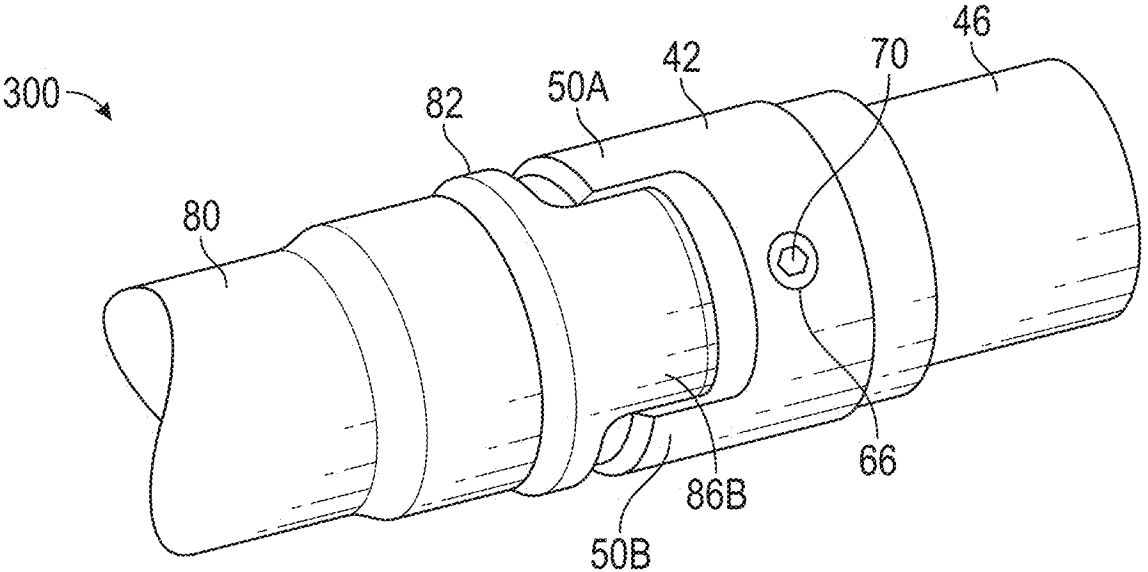
FIG. 5 is a perspective view a portion of the universal joint illustrated schematically in FIG. 4.
Figure 6:
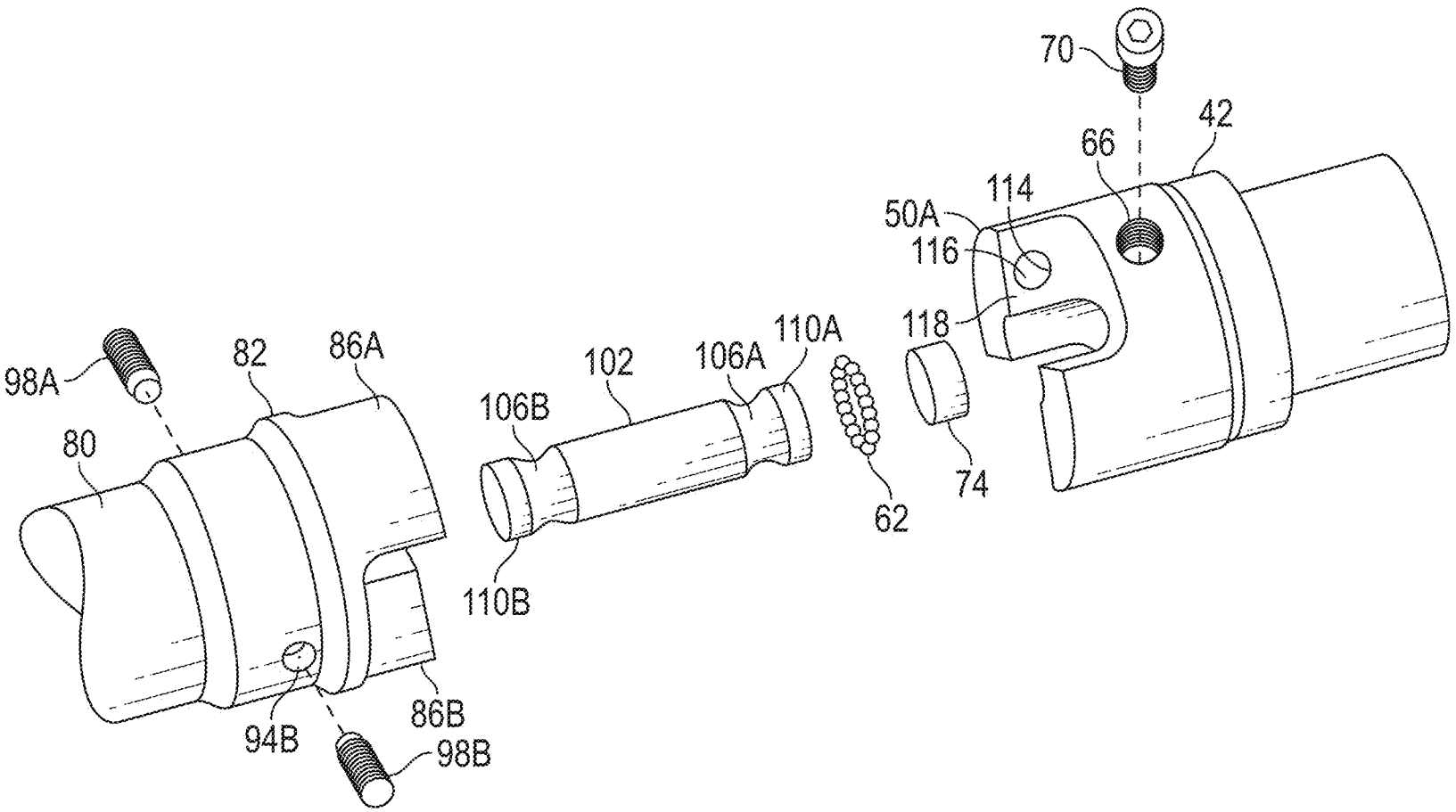
FIG. 6 is an exploded perspective view of the universal joint illustrated schematically FIG. 5.

FIG. 4 is a cross-sectional schematic illustration view of the universal joint assembly used in the embodiment 200 illustrated schematically in FIGS. 2-3. FIG. 5 is a perspective schematic illustration view a portion of the universal joint illustrated schematically in FIG. 4, and FIG. 6 is an exploded perspective schematic illustration view of the universal joint of FIG. 5. Referring briefly once again to FIG. 2, embodiment 100 also features use of a universal joint assembly comprising a cylindrical driver body 42 having a lower pin end 46 threaded into a box end of flow diverter 2. The universal joint assembly is described in my U.S. Pat. No. 8,870,666. The universal joint assembly includes first and second cylindrical driver body members 42, 44, (the latter illustrated in FIGS. 3 and 4) each having one end 46, 48 configured to attach to a drive unit (not illustrated). The configurations to connect to drive units may include external threads or any other connecting feature. First and second cylindrical driver body members 42, 44, each have a pair of diametrically opposed tang portions 50A, 50B, 52A, and 52B, as illustrated in the various views, as well as tapered central blind bores 54, 56, the taper not necessary, but in embodiments providing range of angulation as discussed in U.S. Pat. No. 7,004,843. Each central blind bore 54, 56 includes a circumferential recess 58, 60 accommodating a plurality of ball bearings 62, 64. In certain embodiments there may be more than one circumferential recess, and these recesses may be the same or different in width and depth to accommodate same or different size balls.

Referring to FIG. 5, each of cylindrical driver body members 42, 44 further include at least one perpendicular bore 66, 68 (68 is not illustrated) through which balls are supplied to the assemblies during make-up of the assemblies. Cap screws 70, 72 (72 is not illustrated) seal the perpendicular bores 66, 68, respectively.

Each of cylindrical driver body members 42, 44 further include cylindrical bearing members 74, 76, as clearly illustrated in FIGS. 4, 5, and 6.

As noted previously, the universal joint further includes a cylindrical driven body member 80 having first and second ends 82, 84, each having respective diametrically opposed tang portions 86A, 86B, 88A, and 88B, as well as non-tapered central blind bores 90, 92. Each of first and second ends 82, 84 include a pair of perpendicular bores 94A, 94B, 96A, and 96B positioned behind respective tang portions 86A, 86B, 88A, 88B (88B is not illustrated), and held in by respective set screws 98A, 98B, 100A, 100B. The position of bores 94 and corresponding set screws 98 correspond in turn to the position of neck portions 106A, 106B, 108A, 108B of connecting rods 102, 104. Connecting rods 102, 104 may each have respective crowned head portions 110A, 110B, 112A, 112B on opposites ends thereof, as in U.S. Pat. No. 7,004,843.

As with the previously patented assemblies of U.S. Pat. No. 7,004,843, cylindrical driver body members 42, 44, and cylindrical driven body member 80 are loosely retained one to the other by the connecting rods 102, 104. This loose fitting arrangement allows torque to be transmitted from one member to the other via interfacing tang portions while still allowing for angular defection. Unlike universal joints generally used in connection with mud motor drives, the universal joint assembly described here does not rely on the connecting rods to transmit torque. The connecting rods simply retain the members 42, 44, and 80 in close proximity with each other longitudinally Obviously, angulations of the assemblies may be increased (or decreased) by adding (or removing) joints connected by intermediate tubular members thereby compounding (or reducing) the deflection angle relative to the central axes of the assembly.

A further feature of certain embodiments is the provision of one or more cavities 114 and rubber inserts 116 (FIG. 6) therein to reduce "backslapping" on tang faces 118 during use of the assemblies. This is further described in my '666 patent. Backslapping may occur when the assemblies are quickly reversed by a drive unit, such as when running down hole and then quickly reversed out of hole. While the slack discussed above allows angularity of the assemblies down hole, backslapping reduces life expectancy of the units. Reduction of backslapping is therefore desired. In embodiments having rubber inserts, backslapping, or the effects thereof, may be substantially reduced or eliminated. As may seen in the various figures of the '666 patent and FIG. 6 herein, cavities 114 and rubber inserts 116 may comprise one or a plurality of cavities and corresponding inserts, and the cavities and inserts make take any suitable arrangement, size, and position on faces of one or more tang portions. Even the provision of one cavity and one corresponding rubber insert on one tang portion may reduce the effects of backslapping. Preferably, each tang portion will have at least one rubber-filled cavity, but this is certainly not necessary.

Housings, flex rods, mandrels, bearing members, connecting rods, driver body members, driven body members, balls, cap screws, setscrews, and associated components used in apparatus of the present disclosure may be comprised of metal, ceramic, ceramic-lined metal, or combination thereof. Suitable metals include carbon steels, stainless steels, for example, but not limited to, 306 and 316 steel, hardened versions of these, as well as titanium alloys, aluminum alloys, and the like. High-strength materials like C-110 and C-125 metallurgies that are NACE qualified may be employed for bearing members, connecting rods, driver body members, driven body members, balls, cap screws, setscrews, and associated components. (As used herein, "NACE" refers to the corrosion prevention organization formerly known as the National Association of Corrosion Engineers, now operating under the name NACE International, Houston, Texas.) Use of high strength steel and other high strength materials may significantly reduce weight of these components.

The housings, flex rods, mandrels, bearing members, connecting rods, driver body members, driven body members, balls, cap screws, setscrews, and associated components, or portions thereof, may comprise the same or different corrosion resistant and/or fatigue resistant material, at least one of the corrosion and/or fatigue resistance being able to withstand the expected down hole service conditions experienced during a drilling or other operation.

In certain embodiments, the housings, flex rods, mandrels, bearing members, connecting rods, driver body members, driven body members, balls, cap screws, setscrews, and associated components, or portions thereof such as surface coatings, may comprise same or different noble metals or other exotic corrosion and/or fatigue-resistant materials, such as platinum (Pt), ruthenium (Ru), rhodium (Rh), palladium (Pd), silver (Ag), osmium (Os), iridium (Ir), and gold (Au); alloys of two or more noble metals; and alloys of one or more noble metals with a base metal. In certain embodiments the contact surfaces of housings, bearing members, connecting rods, driver body members, driven body members, balls, cap screws, setscrews, and associated components seat, post, driver, balls, cap screws, setscrews, driven, and/or drivers may comprise a platinum/rhodium alloy skin or coating attached to base metal using a variety of techniques.

When in alloyed form, alloys of two or more noble metals may have any range of noble metals. For example, alloys of two noble metals may have a range of about 0.01 to about 99.99 percent of a first noble metal and 99.99 to 0.01 percent of a second noble metal. Any and all ranges in between 0 and 99.99 percent first noble metal and 99.99 and 0 percent second noble metal are considered within the present disclosure.

In certain noble metal alloy embodiments comprising three or more noble metals, the percentages of each individual noble metal may range from equal amounts of all noble metals in the composition (about 33.33 percent of each), to compositions comprising, or consisting essentially of, 0.01 percent of a first noble metal, 0.01 percent of a second noble metal, and 99.98 percent of a third noble metal. Any and all ranges in between about 33.33 percent of each, and 0.01 percent of a first noble metal, 0.01 percent of a second noble metal, and 99.98 percent of a third noble metal, are considered within the present disclosure.

The choice of a particular material is dictated among other parameters by the chemistry, pressure, and temperature of mud used and type of formation fluid(s) and other fluids, such as treatment fluids, to be encountered. The skilled artisan, having knowledge of the particular application, pressures, temperatures, and available materials, will be able design the most cost effective, safe, and operable seat, post, driver, balls, cap screws, driven, and drivers for each particular application without undue experimentation.

The terms "corrosion resistant" and "fatigue resistant" as used herein refer to two different failure mechanisms that may occur simultaneously, and it is theorized that these failure mechanisms may actually influence each other in profound ways. It is preferred that the housings, flex rods, mandrels, bearing members, connecting rods, driver body members, driven body members, balls, cap screws, setscrews, and associated components have a satisfactory service life of at least six months under conditions existing in a continuous operation, and it is especially preferred that they have a service life greater than twelve months.

In still other embodiments, rubber inserts may be interference or "press" fit to their respective cavities without use of adhesive or primers. In these embodiments, the cavities are machined to sufficiently close tolerances to enable deformation of the rubber insert as the insert is forced into the cavity.

Housings, flex rods, mandrels, bearing members, connecting rods, driver body members, driven body members, balls, cap screws, setscrews, and associated components described herein may be made using a variety of processes, including molding, machining, net-shape cast (or near-net shape cast) using rapid prototype (RP) molds and like processes. Net-shape or near-net shape casting methods of making a variety of molds for producing a variety of complex products are summarized in patents assigned to 3D Systems, Inc., Rock Hill, South Carolina, U.S.A., for example U.S. Pat. No. 8,285,411.

In manufacturing the thrust bearing housing having offset or skewed bore, a steel cylinder or other shape (billet steel) would first have the bore internal diameter (ID) bore to print, leaving the outside diameter (OD) oversized. A portion of the OD would then be clamped within a "Kicked" or offset sleeve, followed by turning the (OD) to size and complete offset housing.

Properties of the rubber insert(s) depend on the assembly geometry used and conditions down hole expected, but generally should have the ability to withstand high temperatures (up to at least about 150° C. (300° F.) or higher) and can withstand harsh chemicals, like oil-based drilling muds, water-based drilling muds, and hydrocarbons, including crude oil and sour fluids. In certain embodiments the material also is able to withstand high flow rates of these fluids. All of the rubber inserts need not be the same material or shape. HNBR (hydrogenated nitrile butadiene rubbers) (ASTM D-2000 classification DH) have recently been developed to meet higher temperatures than standard NBR while retaining resistance to petroleum based oils. Obtained by hydrogenating the nitrile copolymer, HNBR fills the gap left between NBR, EPDM (ethylene-propylene-diene monomer) and FKM (fluorocarbon rubber) elastomers where high temperature conditions require high tensile strength while maintaining excellent resistance to motor oils, sour gas, amine/oil mixtures, oxidized fuels, and lubricating oils. HNBR is resistant to mineral oil-based hydraulic fluids, animal and vegetable fats, diesel fuel, ozone, sour gas, dilute acids and bases. HNBR also resists new bio-oils (biological oils). HNBR is suitable for high dynamic loads and has a good abrasion resistance. HNBR is published to be suitable for temperatures from −30° C. to +150° C. (−20° F. to +302° F.). Properties of HNBR rubbers are summarized in Table 1 (from Robinson Rubber Products Co., Minneapolis, MN).

TABLE 1

| HNBR rubber properties | |
|---|---|
| Physical & Mechanical Properties | |
| Durometer or Hardness Range | 30-95 Shore A |
| Tensile Strength Range | 1,500-3,500 PSI |
| Elongation (Range %) | 90%-550% |
| Abrasion Resistance | Good to Excellent |
| Adhesion to Metal | Excellent |
| Adhesion to Rigid Materials | Good to Excellent |
| Compression Set | Good to Excellent |
| Flex Cracking Resistance | Fair to Good |
| Impact Resistance | Excellent |
| Resilience/Rebound | Good |
| Tear Resistance | Good to Excellent |
| Vibration Dampening | Fair to Good |
| Chemical Resistance | |
| Acids, Dilute | Good |
| Acids, Concentrated | Fair to Good |
| Acids, Organic (Dilute) | Good |
| Acids, Organic (Concentrated) | Fair to Good |
| LP gases and Fuel Oils | Excellent |
| Oil resistance | Good to Excellent |
| Petroleum Aromatic | Good to Excellent |
| Petroleum Non-Aromatic | Good to Excellent |

One HNBR rubber found useful is available from Molded Rubber Specialties, LLC, Carencro, Louisiana under the trade designation 90 durometer HNBR (HSN). This particular HNBR has the following specifications: Shore A Hardness=85-92; specific gravity=1.3-1.35; tensile (ultimate) =2800-3100 psi; Modulus (100%)=1500-1800; Elongation %=125-200; Comp Set, %, 22 hours @ 392° F.=30; Color, black.

Other HNBR rubbers may be suitable, such as 50 percent $Li_2CO_3$/50 percent HNBR (GE 2058), available from RheinChemie under the trade designation RHENOGRAN, may be useful in certain service conditions.

Other materials, such as XNBR (carboxylated nitrile butadiene rubbers) may be used in certain applications. In XNBR rubbers, the carboxyl group is added to significantly improve the abrasion resistance of NBR while retaining excellent oil and solvent resistance. XNBR compounds provide high tensile strength and good physical properties at high temperatures. XNBR is published to be suitable for temperatures from −30° C. to +150° C. (−20° F. to +302° F.).

Certain materials have not fared well in down hole service for this application, such as polyurethanes, as they do not seem to hold their form as well as HNBR after exposure to higher down hole temperatures, and thus are not preferred. However, in an emergency, these materials could be used for limited times until replaced by HNBR or XNBR, for example.

In certain embodiments it has been found useful to employ an adhesive, in certain embodiments with a primer, to adhere the rubber inserts into the cavities. For example, when using one of the preferred HNBR rubber inserts mentioned above available under the trade designation 90 durometer HNBR (HSN), it has been found useful to first prime the rubber insert and/or the cavities with an aliphatic amine primer such as that known under the trade designation LOCTITE 770 (available from Henkel) followed by an aliphatic cyanoacrylate, elastomer-toughened, one-part, atmospheric temperature- and moisture-cured adhesive such as that known under the trade designation LOCTITE 4203 (available from Henkel). This combination of primer, adhesive, rubber insert, and cylindrical cavity in a stainless steel tang worked well in high flow rate down hole environments; the same rubber inserts in the same cavities with different adhesive systems were unsatisfactory as they did not remain in the cavities for long time as expected in those down hole flow rates. Other primer/adhesive combinations, or adhesives without primer, may be satisfactory depending on the service conditions. For example, certain aliphatic cyanoacrylate adhesives need not be elastomer-toughened, or one-part, or atmospheric temperature-curable, or moisture-curable.

Assembly of the universal joint useful in this disclosure proceeds by placing cylindrical bearing members slidably within the internal blind bore of each driver body member. Then the connecting rods are inserted against the bearing members. Balls are then dropped into perpendicular holes and sit in recesses in the neck portions of the connecting rods and corresponding circumferential recesses in the internal blind bores of the drivers. Cap screws hold the balls in. The cylindrical driven body member is then inserted over the connecting rods, and at least one setscrew is screwed down onto neck portions of the connecting rods as illustrated herein. Rubber inserts may be integral to drivers, or placed therein in the field using suitable drills to create cavities, followed by priming and application of adhesive as desired, depending on the desired performance and service conditions.

Certain bearing assembly, drilling motors, and drillstrings of this disclosure may include a combination flow diverter 2 and integral radial drilling motor bearing, as described in my U.S. Pat. No. 9,279,289. Combination flow diverter and integral radial bearings of this type include a bearing material comprising a plurality of tungsten carbide portions surrounded by a hard metal alloy matrix. The hard metal alloy matrix comprises at least one carbide selected from carbides of chrome, carbides of boron, and mixtures thereof, the remainder of the hard metal alloy matrix comprising a binder metal selected from iron, cobalt, nickel, and mixtures thereof.

In certain embodiments, the combination flow diverter 2' and integral radial drilling motor bearing has the at least one carbide portion 60 present at a weight percentage of at least 30 weight percent, based on total weight of the at least one carbide and binder. The plurality of tungsten carbide portions 60 may be bonded to the generally cylindrical outer surface 42 of the second threaded box end 34 using a heating mechanism, such as tack welding, brazing, adhesive bonding, or other. In certain embodiments the plurality of tungsten carbide portions are solid cylindrical-shaped having an outer diameter (OD) ranging from about 0.100 inch up to about 0.500 inch (25.4 mm to 130 mm), and height ranging from about 0.03 inch up to about 0.25 inch (7.62 mm to 63.5 mm). Further details may be access in my U.S. Pat. No. 9,279,289.

Referring again to FIG. 2, bearing assembly embodiment 100 includes a mandrel catch 22 that in certain embodiments may be integral with a heat shrink-fitted sleeve portion of lower radial bearing 18. Mandrel catch 22 may be any integral device that allows the mandrel to catch onto an inner shoulder of lower bearing housing 26 in case of a break of mandrel 4 or flow diverter 2 above the mandrel catch, and may simply be a large diameter hardened steel portion of the sleeve portion of lower radial bearing 18. Alternatively, lower radial sleeve portion of lower radial bearing 18 may screw onto mandrel 4 via threads on the top of bit box 6 of mandrel 4, rather than being heat-shrink fit to mandrel 4. An end nut or sleeve may then be slid over lower radial sleeve portion of lower radial bearing 18. As illustrated in my U.S. Pat. No. 9,279,289, a safety nut having wrench faces and a slightly larger diameter lower portion may then be screwed onto external threads of lower radial bearing 18, mating with internal threads of the nut. During operation, in case of a break in mandrel 4 above the safety nut or a break in flow diverter 2, the slightly larger diameter lower portion of the safety nut interferes with an inner shoulder of lower radial bearing housing 26 and will not allow the safety nut, lower radial sleeve bearing housing 26, and mandrel 4 to be lost down hole.

Figure 7:
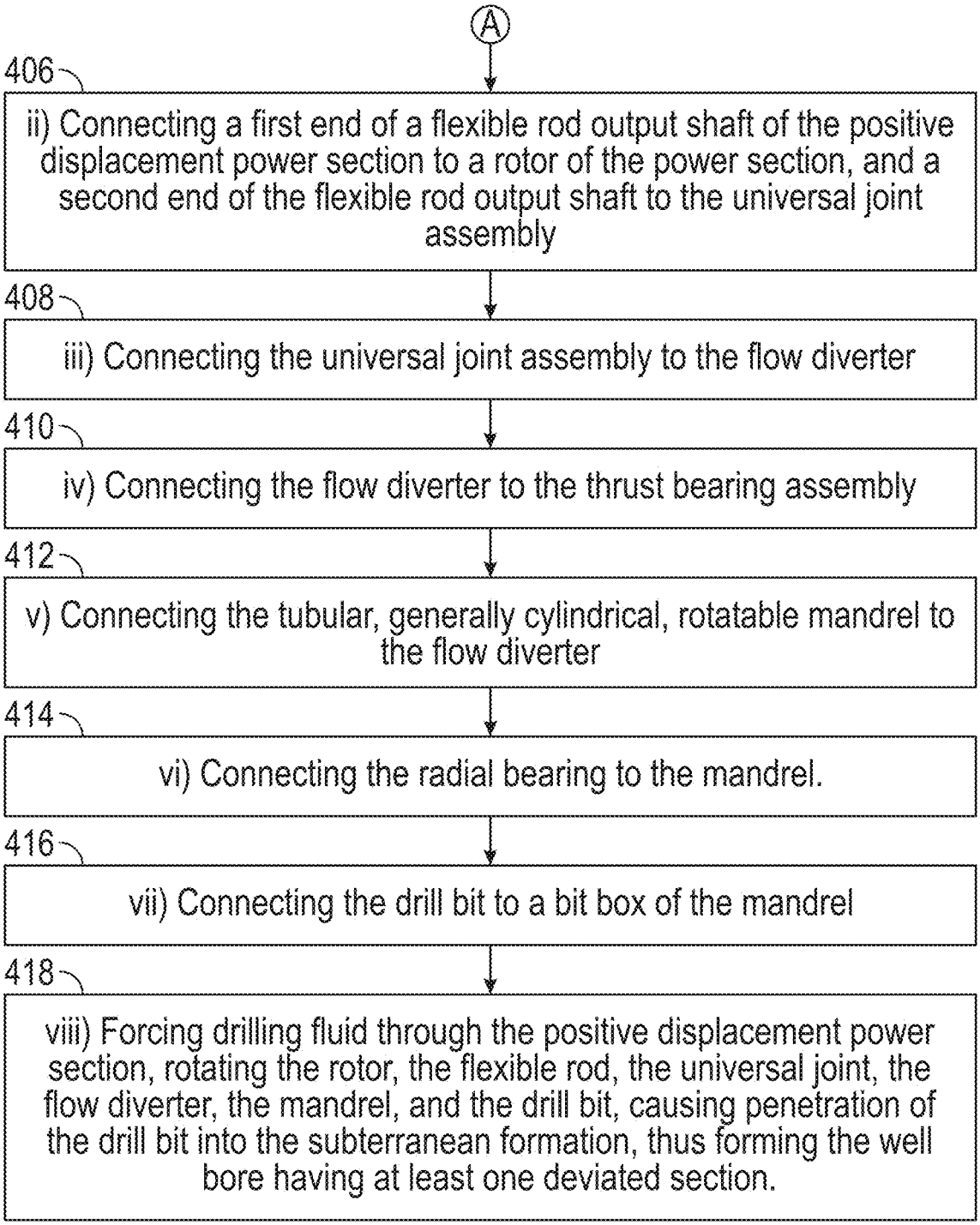
FIG. 7 is a logic diagram of one method of using a drillstring of this disclosure to drill a well bore, at least a portion of the well bore having a deviated section.

FIG. 7 is a logic diagram of one method embodiment 400 of using a drillstring of this disclosure to drill a well bore, at least a portion of the well bore having a deviated section in accordance with the present disclosure. Method embodiment 400 is a method of drilling a well bore in a subterranean formation having at least one deviated section, the method comprising (box 402) assembling a drillstring by (box 404):

connecting a positive displacement motor housing of a positive displacement power section to a thrust bearing assembly above a drill bit in a drillstring, the thrust bearing assembly comprising:

A) a tubular thrust bearing housing having first and second threaded ends, an inside surface, an inside diameter, a generally cylindrical outside surface, an outer diameter, the tubular thrust bearing housing having a longitudinal axis parallel to the generally cylindrical outside surface, the inside surface defining a longitudinal bore having a longitudinal axis skewed at a first angle from the housing longitudinal axis;

B) a thrust bearing stack having an outside surface adjacent the inside surface of the tubular housing, and an inside surface adjacent a tubular, generally cylindrical, rotatable mandrel connecting a flow diverter of a drilling motor power section with a drive shaft for a drill bit;

C) the tubular, generally cylindrical mandrel having a central longitudinal bore having a mandrel longitudinal axis identical to the skewed longitudinal axis of the tubular thrust bearing housing such that the mandrel and drill bit are skewed at the first angle to the tubular housing;

D) the positive displacement power section comprising a generally cylindrical motor housing having an inside surface, a rotor and a stator, the rotor connected at one end to a flex rod drive shaft, the flex rod drive shaft in turn threadedly connected via a universal joint assembly to the flow diverter, the flow diverter having a lower diverter box end threadedly connected to a threaded pin end of the mandrel, the mandrel having a second end forming a drive shaft and bit box, the inside surface of the motor housing defining a longitudinal bore having a longitudinal axis, the longitudinal axis skewed at a second angle from the thrust bearing tubular housing longitudinal axis;

E) the first end of the thrust bearing tubular housing threadedly connected to the generally cylindrical motor housing, the second end of the thrust bearing tubular housing connected to a radial bearing housing enclosing a radial bearing for the mandrel.

Method embodiment 400 further comprises connecting, in no particular order:

connecting a first end of a flexible rod output shaft of the positive displacement power section to a rotor of the power section, and a second end of the flexible rod output shaft to a universal joint assembly (box 406), connecting the universal joint assembly to a flow diverter (box 408);

connecting the flow diverter to the thrust bearing assembly (box 410);

connecting a tubular, generally cylindrical, rotatable mandrel to the flow diverter (box 412);

connecting a radial bearing to the mandrel (box 414);

connecting a drill bit to a bit box of the mandrel (box 416); and forcing drilling fluid through the positive displacement power section, rotating the rotor, the flexible rod, the universal joint, the flow diverter, the mandrel, and the drill bit, causing penetration of the drill bit into the subterranean formation, thus forming the well bore having at least one deviated section (box 418).

Although only a few exemplary embodiments of this disclosure have been described in detail above, those skilled in the art will readily appreciate that many modifications are possible in the exemplary embodiments without materially departing from the novel teachings and advantages of this disclosure. Accordingly, all such modifications are intended to be included within the scope of this disclosure as defined in the following claims. In the claims, no clauses are intended to be in the means-plus-function format allowed by 35 U.S.C. § 112, Section F, unless "means for" is explicitly recited together with an associated function. "Means for" clauses are intended to cover the structures, materials, and acts described herein as performing the recited function and not only structural equivalents, but also equivalent structures.

What is claimed is:

1. A drilling motor power section and thrust bearing assembly, comprising:

a) a thrust bearing tubular housing having first and second threaded ends, an inside surface, an inside diameter, a generally cylindrical outside surface, an outer diameter, the thrust bearing tubular housing having a longitudinal axis parallel to the generally cylindrical outside surface, the inside surface defining a longitudinal bore having a bore longitudinal axis skewed at a first angle from the thrust bearing housing longitudinal axis;

b) a thrust bearing stack having an outside surface adjacent the inside surface of the thrust bearing tubular housing, and an inside surface configured to be adjacent a tubular, generally cylindrical, rotatable mandrel connecting a flow diverter of a drilling motor power section with a drive shaft for a drill bit;

c) the tubular, generally cylindrical mandrel having a central longitudinal bore having a mandrel longitudinal axis identical to the skewed longitudinal axis of the tubular housing such that the mandrel and drill bit are skewed at the first angle to the tubular housing;

d) a positive displacement drilling motor power section having a generally cylindrical motor housing having an inside surface, a rotor and a stator, the rotor connected at one end to a flex rod drive shaft, the flex rod drive shaft in turn threadedly connected via a universal joint assembly to the flow diverter, the flow diverter having a lower diverter box end threadedly connected to a threaded pin end of the mandrel, the mandrel having a second end forming a drive shaft and bit box, the inside surface of the motor housing defining a longitudinal bore having a longitudinal axis, the longitudinal axis skewed at a second angle from the thrust bearing tubular housing longitudinal axis;

e) the first end of the thrust bearing tubular housing threadedly connected to the generally cylindrical motor housing, the second end of the thrust bearing tubular housing connected to a radial bearing housing enclosing a radial bearing for the mandrel.

2. The assembly of claim 1 wherein the thrust bearing housing has a transverse cross-section such that the inside diameter and outside diameter are constant, wherein a center of first circle defined by the outside diameter is positioned on the longitudinal axis, and a center of a second circle defined by the inside diameter is on the skewed longitudinal axis.

3. The assembly of claim 1 wherein the first angle ranges from about 0.5 to about 5 degrees.

4. The assembly of claim 1 wherein the first angle ranges from about 0.5 to about 2 degrees.

5. The assembly of claim 1 wherein the second angle ranges from about 0.5 to about 5 degrees.

6. The assembly of claim 1 wherein the second angle ranges from about 0.5 to about 2 degrees.

7. The assembly of claim 1 wherein addition of the first and second angles allows a total bend angle ranging from about 1.0 to about 10 degrees.

8. The assembly of claim 1 wherein addition of the first and second angles allows a total bend angle ranging from about 1.0 to about 4 degrees.

9. The assembly of claim 1 wherein the thrust bearing assembly inside surface is generally cylindrical.

10. The assembly of claim 1 wherein the thrust bearing stack comprises bearing members selected from the group consisting of thrust ball bearings, angular contact thrust ball bearings, cylindrical roller thrust bearings, needle roller thrust bearings, spherical roller thrust bearings, tapered roller thrust bearings, and combinations thereof.

11. The assembly of claim 1 wherein the thrust bearing stack is lubricated by a fluid selected from the group consisting of drilling fluid, reservoir fluid, or combination thereof.

12. A drillstring comprising the drilling motor power section and thrust bearing assembly of claim 1 and a drill bit secured to the bit box.

13. A drillstring comprising the drilling motor power section and thrust bearing assembly of claim 8 and a drill bit secured to the bit box.

14. A method of drilling a well bore in a subterranean formation having at least one deviated section, the method comprising, in no particular order:

a) assembling a drillstring by:

i) connecting a positive displacement motor housing of a positive displacement power section to a thrust bearing assembly, the thrust bearing assembly comprising:

A) a tubular thrust bearing housing having first and second threaded ends, an inside surface, an inside diameter, a generally cylindrical outside surface, an outer diameter, the tubular thrust bearing housing having a longitudinal axis parallel to the generally cylindrical outside surface, the inside surface defining a longitudinal bore having a longitudinal axis skewed at a first angle from the thrust bearing housing longitudinal axis;

B) a thrust bearing stack having an outside surface adjacent the inside surface of the tubular thrust bearing housing, and an inside surface adjacent a tubular, generally cylindrical, rotatable mandrel connecting a flow diverter of a drilling motor power section with a drive shaft for a drill bit;

C) the tubular, generally cylindrical mandrel having a central longitudinal bore having a mandrel longitudinal axis identical to the skewed longitudinal axis of the tubular thrust bearing housing such that the mandrel and drill bit are skewed at the first angle to the tubular housing;

D) the positive displacement power section comprising a generally cylindrical motor housing having an inside surface, a rotor and a stator, the rotor connected at one end to a flex rod drive shaft, the flex rod drive shaft in turn threadedly connected via a universal joint assembly to the flow diverter, the flow diverter having a lower diverter box end threadedly connected to a threaded pin end of the mandrel, the mandrel having a second end forming a drive shaft and bit box, the inside surface of the motor housing defining a longitudinal bore having a longitudinal axis, the longitudinal axis skewed at a second angle from the thrust bearing tubular housing longitudinal axis;

E) the first end of the thrust bearing tubular housing threadedly connected to the generally cylindrical motor housing, the second end of the thrust bearing tubular housing connected to a radial bearing housing enclosing a radial bearing for the mandrel;

ii) connecting a first end of the flexible rod drive shaft of the positive displacement power section to the rotor of the power section, and a second end of the flexible rod drive shaft to a universal joint assembly;

iii) connecting the universal joint assembly to the flow diverter;

iv) connecting the flow diverter to the thrust bearing assembly;

v) connecting the tubular, generally cylindrical, rotatable mandrel to the flow diverter;

vi) connecting the radial bearing to the mandrel;

vii) connecting the drill bit to the bit box of the mandrel;

b) forcing drilling fluid through the positive displacement power section, rotating the rotor, the flexible rod drive shaft, the universal joint, the flow diverter, the mandrel, and the drill bit, causing penetration of the drill bit into the subterranean formation, thus forming the well bore having at least one deviated section.

15. The method of claim 14 wherein step (b) comprises drilling the well bore at a deviation angle ranging from about 1 to about 10 degrees.

16. The method of claim 14 wherein step (b) comprises drilling the well bore at a deviation angle ranging from about 1 to about 4 degrees.

17. The method of claim 14 wherein the thrust bearing stack is lubricated by a fluid selected from the group consisting of the drilling fluid, a reservoir fluid, or combination thereof.

* * * * *